United States Patent [19]

Yoder

[11] Patent Number: 4,689,001

[45] Date of Patent: Aug. 25, 1987

[54] BAT FOR POTTERS WHEEL

[75] Inventor: Carole Yoder, Arlington, Tex.

[73] Assignee: Plasti-Bat, Inc., Independence, Mo.

[21] Appl. No.: 726,405

[22] Filed: Apr. 23, 1985

[51] Int. Cl.[4] ..... B28B 5/06

[52] U.S. Cl. ..... 425/183; 425/263; 425/459

[58] Field of Search ..... 425/263, 459, 183; 369/264, 270; 269/280; 51/216 T, 217 T, 229, 237 R, 240 T, 247, DIG. 34, 394–407; 428/64

[56] References Cited

U.S. PATENT DOCUMENTS

| | | | |
|---|---|---|---|
| 38,905 | 6/1863 | Marcher | 425/263 |
| 1,377,785 | 5/1921 | Odelberg | 425/459 |
| 1,602,122 | 10/1926 | Reed | 425/459 |
| 1,673,903 | 6/1928 | Cripe et al. | 51/216 R |
| 1,747,192 | 2/1930 | Strand | 425/263 |
| 1,953,983 | 4/1934 | Benner | 51/395 |
| 2,104,241 | 1/1938 | Proctor | 369/270 |
| 2,644,280 | 7/1953 | O'Neill | 51/404 |
| 2,716,312 | 8/1955 | Speicher | 51/209 R |
| 3,082,582 | 3/1963 | Jeske | 51/407 |
| 3,453,783 | 7/1969 | Queen | 51/237 R |
| 3,844,072 | 10/1974 | Haigh et al. | 51/405 |
| 3,849,054 | 11/1974 | Jordache | 425/459 |
| 4,028,041 | 6/1977 | Zambrano | 425/459 |
| 4,222,577 | 9/1980 | Giffin | 425/459 |
| 4,239,567 | 12/1980 | Winings | 51/237 R |

FOREIGN PATENT DOCUMENTS

| | | | |
|---|---|---|---|
| 2812852 | 10/1978 | Fed. Rep. of Germany | 192/107 M |
| 2747547 | 4/1979 | Fed. Rep. of Germany | 369/264 |
| 6701165 | 8/1967 | Netherlands | 425/263 |
| 324298 | 1/1930 | United Kingdom | 425/263 |
| 775658 | 5/1957 | United Kingdom | 369/264 |
| 1246615 | 9/1971 | United Kingdom | 425/263 |

*Primary Examiner*—Willard E. Hoag

*Attorney, Agent, or Firm*—Edward F. Connors

[57] ABSTRACT

A bat for the wheelhead of a potters wheel is formed entirely from plastic and has opposing flat faces, one of which is smooth and other of which is textured.

1 Claim, 4 Drawing Figures

BAT FOR POTTERS WHEEL

BACKGROUND OF THE INVENTION

1. Field of the Invention

The present invention relates to improvements in bats for the wheelheads used in schools and studios by potters and sculptors in the formation of clay pieces.

2. Discussion of the Prior Art

Bats are well known for use to form working surfaces on the wheelheads of potters wheels. Most commonly, bats are formed from wood or slate and such surfaces tend to splinter, delaminate, swell or shrink.

The known bats are subject to wear due to continuous heavy usage and can be harmed by being soaked in water. Furthermore, the slate or wooden bats have surfaces that become absorbent and upon which the clay can slide or turn loosely in a manner to damage the piece and to irritate the hands of the potter.

OBJECTS AND SUMMARY OF THE PRESENT INVENTION

The primary object of the present invention is to provide a bat formed entirely from plastic materials like various combinations or blends of polymers, such as polyethylene, polyproplene, etc.

Another major object of the present invention is to provide a more versatile and longer lasting carefree bat which will last many years with very little care.

Another major object is to provide a plastic boat in which the pin holes will remain exactly as drilled and which will not become oversized with use.

DESCRIPTION OF THE PREFERRED EMBODIMENT

Figure 1:
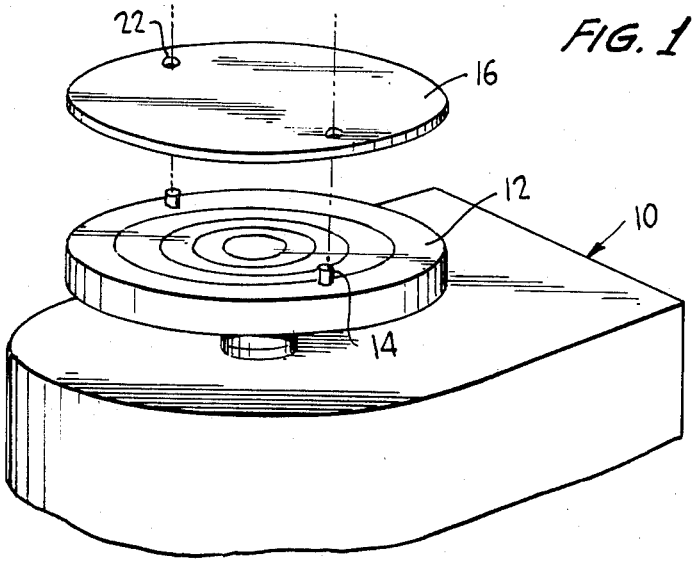
FIG. 1 is a perspective view of the wheelhead of a potters wheel showing the bat of the present invention in detached relation therewith.
Figure 2:
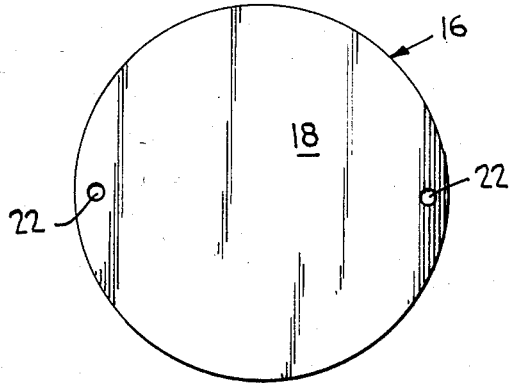
FIG. 2 is a vertical cross-sectional view of the assembled bat and wheelhead.

Referring now more particularly to the accompanying drawings and, initially to FIG. 1, reference numeral

10 generally designates a conventional potters wheel with a wheelhead 12 from which bat pins 14 upstand. The bat pins 14 are conventionally two in number and are diametrically spaced apart on opposite sides of the center of the wheelhead.

The bat 16 of the present invention is formed entirely from plastic materials. For example, the following six materials can be used in producing this bat to give it strength, rigidity, toughness and optimum weight. They are used in combinations and/or blends with each other.

ABS (Acrylonitrile Butadiene Styrene) is a terpolymer.

PVC (Polyvinylchloride) is a single polymer.

HIPS (High Impact Styrene) is a styrene and rubber.

SAN (Styrene Acrylonitrile) is a co-polymer.

PE (Polyethylene) is a single polymer.

PP (Polyprolene) is a single polymer.

Figure 3:
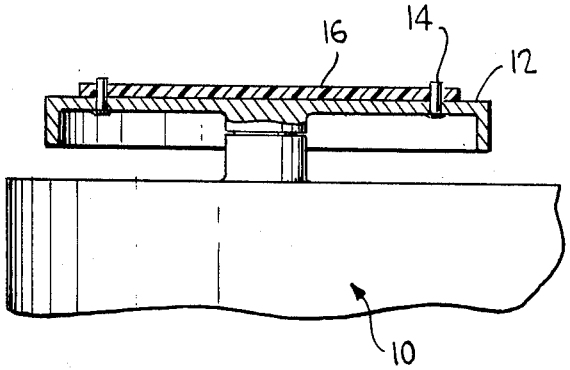
FIG. 3 is a plan view of one face or surface of the bat.
Figure 4:
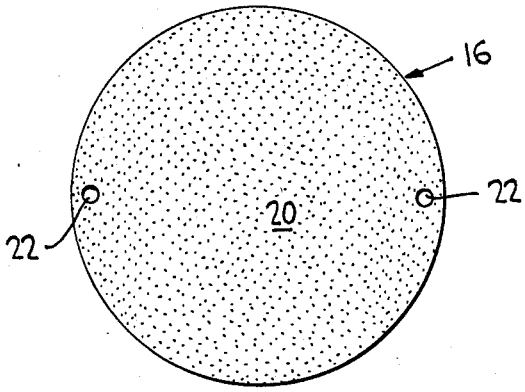
FIG. 4 is a plan view of the opposing face or surface of the bat.

The bat 15 has opposing faces or surfaces 18 and 20, as shown in FIGS. 3 and 4. The surface 18 is flat and smooth while the surface 20 is flat and textured or roughened.

The bat is drilled axially through the faces 18 and 20 with diametrically opposing holes 22 to receive the bat pins 14.

The textured surface 18 is used as the working surface in forming the clay pieces while the smooth surface 20 is used in the final trimming of the pieces or pot so that when the pot pops free, the bottom of the piece will have a totally smooth, surface.

The bat 16 can be drilled for any bat pin hole pattern and can be of any thickness or any geometrical form but, most usually, is circular. The holes 22 will remain in perfect condition and will not become oversized with use.

While the best known form of the present invention has been disclosed herein, it is to be understood that changes may be made as come within the purview of the appended claims.

What is claimed is:

1. A potters wheel comprising a turntable having two, axially aligned upright pins extending from the major upward facing surface of said turntable and a polymeric disc having holes, adjacent its peripheral edges, mating with said pins, said disc being removable from said turntable and having a smooth surface on one side and a rough textured surface on the opposite side.

* * * * *